US005091054A

United States Patent [19]

Meier et al.

[11] Patent Number: 5,091,054

[45] Date of Patent: Feb. 25, 1992

[54] PROCESS FOR BLEACHING AND DELIGNIFICATION OF LIGNOCELLULOSIC

[75] Inventors: Juergen Meier, Elmwood Park; Gerhard Arnold, Ringwood, both of N.J.

[73] Assignee: Degussa Corporation, Ridgefield Park, N.J.

[21] Appl. No.: 395,520

[22] Filed: Aug. 18, 1989

[51] Int. Cl.[5] ..... D21C 9/147; D21C 9/16

[52] U.S. Cl. ..... 162/65; 162/78; 162/76

[58] Field of Search ..... 162/76, 65, 19, 78, 162/89

[56] References Cited

FOREIGN PATENT DOCUMENTS 0190723 8/1986 European Pat. Off. ..... 162/78
3302580 8/1983 Fed. Rep. of Germany ..... 162/78

OTHER PUBLICATIONS

Liebergott, "Oxidative Bleaching-A Review", 69th Annual Meeting Tech. Sect. Canadian Pulp & Paper Assoc., Feb. 1 and 2, 1983 (162-89).

Zakis et al, "Action of Persulfate on Lignin, I", Translated from Khimiya Drevesiny (Rija) 9=109-117 (1971).

DuPont Data Sheet; "Oxone ® Monopersulfate Compound", Oct. 1976.

*Primary Examiner*—Steve Alvo
*Attorney, Agent, or Firm*—Beveridge, DeGrandi & Weilacher

[57] ABSTRACT

Delignification and bleaching of lignocellulosic material is enhanced after the pulp has been treated with peroxomonosulfuric acid. The starting pH of the reaction with peroxomonosulfuric acid is between 7 and 11, and the reaction is continued until a final pH of 3 to 5 obtained. Subsequently the pulp is delignified and bleached with peroxide and/or oxygen.

27 Claims, No Drawings

PROCESS FOR BLEACHING AND DELIGNIFICATION OF LIGNOCELLULOSIC

BACKGROUND OF THE INVENTION

Bleaching of lignocellulosic materials can be divided into lignin retaining and lignin removing bleaching operations. In the case of bleaching high yield pulps like Groundwood, Thermo-Mechanical Pulp and Semi-Chemical pulps, the objective is to brighten the pulp while all pulp components including lignin are retained as much as possible. This kind of bleaching is lignin retaining. Common lignin retaining bleaching agents used in the industry are alkaline hydrogen peroxide and sodium dithionite (hydrosulfite).

Hydrogen peroxide decomposes into oxygen and water with increasing pH, temperature, heavy metal concentrations, etc. The decomposition products, radicals like HO° and HOO°, lead to lower yields by oxidation and degradation of lignin and polyoses. Therefore, hydrogen peroxide is stabilized with sodium silicates and chelating agents when mechanical pulps (high yield pulps) are bleached.

The bleaching effect is achieved mainly by the removal of conjugated double bonds (chromophores), by oxidation with hydrogen peroxide (P), or reduction with hydrosulfite (Y). Other bleaching chemicals more rarely used are FAS (Formamidine Sulfinic Acid), Borohydride ($NaBH_4$), Sulfur dioxide ($SO_2$), Peracetic acid, and Peroxomonosulfate under strong alkaline conditions.

Pretreatments including electrophilic reagents such as elemental chlorine, chlorine dioxide, sodium chlorite and acid $H_2O_2$ increase the bleaching efficiency of hydrogen peroxide bleaching as described in Lachenal, D., C. de Chondens and L. Bourson. "Bleaching of Mechanical Pulp to Very High Brightness." TAPPI JOURNAL, March 1987, vol. 70, No. 3, pp. 119–122.

In the case of bleaching chemical pulps like kraft pulp, sulfite pulps, NSSC, NSSC-AQ, soda, organosolv, and the like, that is to say with lignocellulosic material that has been subjected to delignifying treatments, bleaching includes further lignin reducing (delignifying) reactions. Bleaching of chemical pulps is performed in one or more subsequent stages. Most common bleaching sequences are CEH, CEHD, CEHDED, CEDED, CEHH. (C chlorination, E caustic extraction, H alkaline hypochlorite and D chlorine dioxide).

In all of these bleaching sequences, the first two stages are generally considered as the "delignification stages". The subsequent stages are called the "final bleaching". This terminology describes the main effects that can be seen by the specific chemical treatments.

While in the first two stages the most apparent effect is the reduction of residual lignin, in the subsequent stages the most distinguishable effect is the increased brightness.

With the development of new mixing devices like high shear mixers at medium consistency, oxygen delignification and oxygen reinforced extraction stages have been commercialized in numerous mills (Teuch, L. Stuart Harper. "Oxygen-bleaching practices and benefits: an overview". TAPPI JOURNAL, vol. 70, No. 11, pp. 55–61).

Although oxygen delignification; i.e. application of oxygen prior to the chlorination (C) stage, could be implemented because of economical advantages, environmental concerns arise. This is due to the considerable amount of chlorinated organic compounds such as dioxins in the paper mill effluent and in the resulting product. These problems have highly accelerated the implementation of oxygen stages to avoid the chlorination products.

Oxygen delignification stages can yield delignification rates of up to 65% on kraft and sulfite pulps. In the industry, however, most mills operate oxygen stages with delignification rates between 40 and 45%, because the reaction becomes less selective at higher delignification rates. As a consequence, pulp viscosity and pulp strength properties drop steeply when operating beyond a delignification rate of about 50%.

As environmental regulations by the authorities in Europe, Canada and in the U.S. are becoming increasingly stringent, extensive research and developments throughout the industry are focused on the enhancement of oxygen delignification. All of these studies have one goal in common; increasing the selectivity of oxygen by increasing the reactivity of the residual lignin prior to the oxygen stage. Several pretreatments have been explored and published. (Fossum, G., Ann Marklund, "Pretreatment of Kraft Pulp is the Key to Easy Final Bleaching", Proc. of International Pulp Bleaching Conference, TAPPI, Orlando 1988, pp. 253–261).
253–261).

All of these pretreatments with elemental chlorine, chlorine dioxide, ozone, nitrogen dioxide, acid hydrogen peroxide, etc. convert lignin to more easily oxidizable substances and make the subsequent oxygen stage more selective towards delignification. At the same time, viscosity loss of the oxygen delignified pulp is reduced.

As the main driving force for the implementation of pretreatments is the reduction of chlorine containing bleaching agents, all processes which use chlorine containing agents are anticipated to have very little viability for the future. Some known pretreatments without chlorine such as Prenox®, $PO_A$ or ozonation involve heavy capital investment and are therefore unattractive from the commercial standpoint.

It is generally presumed that during the acid hydrogen peroxide pretreatment with and without oxygen, the aromatic ring is hydroxylated. This hydroxylation action weakens the ring stability so that the subsequent oxygen treatment can cleave the aromatic ring more easily. The relatively extreme reaction conditions as described by Suess, H. U. and O. Helmling, (Acid hydrogen peroxide/oxygen treatment of kraft pulp prior to oxygen delignification. Proc. International Oxygen Delignification Conference, TAPPI, pp. 179–182, 1987) show that the effect of acid hydrogen peroxide on enhancement of oxygen delignification is very limited.

The effect can be enhanced with organic peracids but organic peracids have the disadvantage that transportation of quantities needed in the pulp and paper industry would be too expensive to be feasible. On-site manufacturing is also not practicable because of the very large sized reaction vessels that would be required. This is due to the fact that long residence times are needed to reach equilibrium. Another disadvantage of using organic peroxides would be that after the reaction, the organic acid and residual peracid in the filtrate would drastically increase the TOC, BOD and COD concentration in the effluent with all its negative environmental impacts.

SUMMARY OF THE INVENTION

An object of the invention is to provide a process for the treatment of lignocellulosic materials using peroxomonosulfuric acid (Caro's acid) and/or its salts in combination with oxygen and/or a peroxide. Caro's acid has the advantage over hydrogen peroxide in that it reacts faster, at milder reaction conditions, and by far more selectively towards lignin oxidation.

It has been found that the treatment of lignocellulosic materials with peroxomonosulfuric acid and/or its salts at a wide range of reaction conditions yields an extraordinary enhancement of subsequent delignification and bleaching in combination with oxygen delignification and oxidative stages containing oxygen and/or a peroxide.

The present invention is characterized by the synergistic effect that at the same time, pulp viscosity is maintained at comparable levels of commonly run oxygen delignification stages and strength properties are even improved.

DETAILED DESCRIPTION OF THE INVENTION

Lignocellulosic materials such as untreated wood, wood chips and annual plants like corn stalks, wheat straw, kenaf and the like can be used in accordance with the invention. Especially suitable is material that has been defiberized in a mechanical, chemical processes or a combination of mechanical and chemical processes such as GW, TMP, CTMP, kraft pulp, sulfite pulp, soda pulp, NSSC, organosolv and the like. It is this kind of material in an aqueous suspension, hereinafter referred to as pulp, which is treated in accordance with the present invention with peroxomonosulfuric acid and/or its salts and subsequently subjected to an oxygen and/or peroxide stage.

Peroxomonosulfuric acid can be applied by dissolving commercial grades of its salts such as Caroat® (Degussa AG) or by on-site generation e.g. by mixing high strength hydrogen peroxide with concentrated sulfuric acid or $SO_3$ prior to the addition point. Peroxomonosulfuric acid and/or its salts can be used alone or simultaneously together with $H_2O_2$ and/or molecular oxygen, preferably without molecular oxygen. The consistency of the pulp can range from 0.01% to 60% preferably from 1% to 30%.

The peroxomonosulfuric acid and/or its salts contains more or less excess acid, depending on its source. Therefore, it is customary that a chemical base such as NaOH, MgO, etc. be added to the pulp in order to control the acidity at a desired pH level. Any suitable alkaline material can be used to control acidity provided it does not adversely effect the process or product. Any sequence of chemical addition, including the simultaneous addition, can be carried out. Typically, the starting pH (after addition of caustic and addition of peroxomonosulfuric acid and/or its salts) is between 7 and 11.

With the course of the reaction, the pH drops to a final pH of 1 to 10 mainly because of the liberation of sulfuric acid. As the sulfuric acid being released derives from the peroxomonosulfate anion, the higher the peroxomonosulfuric acid charge is, the greater is the drop in pH. Typically, the final pH is between 3 and 5.

The Caro's acid treatment is carried out with 0.01% to 3% (based on oven-dry weight of pulp) of active oxygen contained in the peroxomonosulfuric acid and/or salt. Preferred chemical charge is 0.05% to 1.5% AO (active oxygen). Trials have shown that the treatment. (peroxomonosulfuric acid stage) is very little effected by temperature; that is, the reaction is not very temperature dependent. Thus, the peroxomonosulfuric acid (and/or salt) is effective at low temperatures such as 5° C. as well as at temperatures of up to 100° C. Preferable temperatures for the treatment are however in the range of 15° C. and 70° C.

Depending on temperature, pH and chemical charge the residence time required is between 1 second up to 10 hours. It is to be noted that the peroxomonosulfuric acid (and/or salt) stage can be applied to any kind of treated (bleached) or untreated (e.g. brown stock) pulp. Advantageously, one or more heavy metal and organic contaminants eliminating process steps can be carried out to favorably impact the delignification efficiency of the aforesaid stage.

Peroxide stabilizing agents (such as silicate, chelating agents like $Na_5DTPA$, $Na_4EDTA$, DTPMPA, etc.) and cellulose protecting agents like urea, magnesium salts, etc. are favorable or the process. The actual synergistic effects of treatment with peroxomonosulfuric acid (and/or salt) under the described conditions are not immediately apparent right after the treatment. The synergistic effects thereof however become apparent once the pulp is subsequently subjected to oxygen delignification, oxidative extraction with oxygen and/or peroxide or peroxide bleaching.

Thus, according to the invention, the beneficial and synergistic effects achieved by the Caro's acid treatment described hereinafter become apparent after further process steps are carried out; i.e. after oxygen delignification and oxidative extractions such as O, Op, Eo, Ep, Eop, Eoh and P. The effects are dramatically enhanced delignification and bleaching without additional pulp viscosity losses. This result could not have been predicted from what has gone before. As described in "The Chemistry of Delignification", Part II by Gierer J., Holzforschung, 36 (1982), pp. 55-64, acid hydrogen peroxide and organic peracids like peracetic acid hydroxylate the aromatic rings of lignin through the formation of perhydroxonium cations $H_3O_2^+$; that is, $HO^+$.

It is known in the art that hydrogen peroxide does not react readily with Kraft lignin. An explanation can be found in Blaschette A. and D. Brandes Chapter VII, "Nichtradikalische (polare) Reaktionen der Peroxogruppe", pp. 165-181. "Wasserstoffperoxid und seine Derivate", Editor W. Weigert, Huthig Yerlag 1978. Electrophilic substitution on the aromatic ring with a peroxide can also be described as a nucleophilic substitution on the peroxidic oxygen of the peroxygen compound. The $\pi$-electrons of the aromatic group attack nucleophilically the peroxidic oxygen. In the transition state, the $YO^-$ is removed quicker the less basic $YO^-$ is (see reaction below).

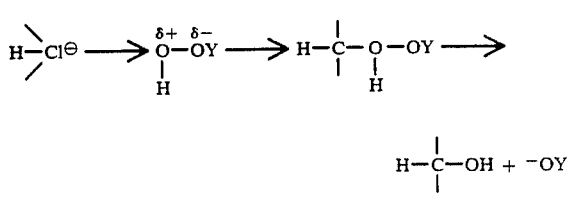

Applying this to the reaction of acid hydrogen peroxide and peracetic acid, it is believed to present an explanation of why hydrogen peroxide is a weaker hydroxylation agent than peracetic acid. In the case of $H_2O_2$, the removed molecule is water ($H_2O$), a relatively weak acid; in the case of peracetic acid it is acetic acid, a moderately strong acid. As peroxomonosulfuric acid removes sulfuric acid (a very strong acid), the hydroxylation occurs more rapidly.

The hydroxylation of the aromatic rings, however, is not enough in order to extract the lignin from the pulp. In a subsequent alkaline oxygen stage, the biradical molecule oxygen or radicals deriving from decomposition of $H_2O_2$ are trapped by the anions of the hydroxylated lignin, which are then oxidized to the quinonoid forms. Under the reaction conditions of these stages quinones are easily further degraded. As a consequence, oxygen and/or $H_2O_2$ is consumed more completely by the additionally hydroxylated lignin. Less attacks of the cellulose are possible which lead to less fiber damage, i.e. higher viscosities, more lignin degradation and bleaching.

The relatively small brightening effect that results from this treatment stage with peroxomonosulfuric acid (and/or its salts) alone is believed likely to arise as a consequence of also partly hydroxylated aliphatic double bonds, partly removal and/or destruction of lignin and lignin fragments and other reactions as described by Gierer, J. The reason why this treatment stage also enhances subsequent alkaline peroxide bleaching stages can be traced back to the same mechanism.

The treatment stage in which peroxomonosulfuric acid and/or its salts is used can be designated by the symbol "X". The new process which is the subject of this invention features a combined application of the X stage with any other kind of oxygen and/or peroxide stage, generally described by the symbol [OX]. The new process can be abbreviated by "X—[OX]" whereby "[OX]" can stand for O (oxygen delignification, Eo, Ep, Eop, Eoh (extraction stages reinforced with oxygen, peroxide, oxygen and peroxide as well as oxygen and hypochlorite, respectively), and P (peroxide stage). The process can be used repeatedly and in combination with other bleaching stages commonly used in order to delignify and bleach to required levels. The two treatments, step X and [OX] can be conducted with and without intermediate washing. If intermediate washing is applied, any kind of wash water not negatively affecting the overall effects of this process can be used, i.e. [OX] filtrate. It is, however, indispensible that the X step is performed prior to the [OX] step.

The following examples serve to illustrate the present invention without limiting it in any way.

EXAMPLE 1

Unbleached southern pine kraft pulp was subjected to an acidic pretreatment in order to eliminate heavy metals from the pulp. The pretreatment was performed at pH 2.0, (adjusted with $H_2SO_4$) 50° C., 2% cons. in the presence of about 0.2% of $Na_2SO_3$ and 0.2% $Na_5DTPA$ for 30 minutes. The pulp was dewatered to 30% consistency without additional washing. The pulp was split into three portions of 50 g oven dry (O.D.) pulp. Each sample was subjected to a $P_{OA}$—Op treatment as described in Table 1. The overall amount of active oxygen applied was the same for all three batches. Washing with deionized water was applied between the $P_{OA}$ and the Op stages to avoid NaOH charge adjustments in the Op stages. Fresh $H_2O_2$ was added to the pulp in the Op stage according to the residual levels in the $P_{OA}$ stage. By that, a $P_{OA}$—Op sequence without intermediate washing should be simulated regarding the consumption of the total AO charge in $P_{OA}$ and Op.

TABLE 1

| | Trial #1 | Trial #2 | Trial #3 |
|---|---|---|---|
| Raw material kappa | 27.6 | 27.6 | 27.6 |
| $P_{OA}$-stage | | | |
| AO (%) | .60[1)] | .60[2)] | .60[3)] |
| $H_2SO_4$ (%) | .64 | — | — |
| NaOH (%) | — | — | .50 |
| $O_2$ (MPa) | .3 | .3 | .3 |
| Consist. (%) | 15.7 | 15.7 | 15.7 |
| Temp. (°C.) | 70 | 70 | 70 |
| Time (min) | 30 | 30 | 30 |
| pH initial | 1.9 | 2.0 | 2.1 |
| pH final | 1.9 | 1.9 | 1.9 |
| Residual AO (%) | .51 | .26 | .37 |
| Op-stage | | | |
| AO (%) | .51 | .26 | .37 |
| NaOH (%) | 3.6 | 3.6 | 3.6 |
| $O_2$ (MPa) | 0.3 | 0.3 | 0.3 |
| Cons. (%) | 20 | 20 | 20 |
| Temp (°C.) | 100 | 100 | 100 |
| Time (min) | 120 | 120 | 120 |
| Resid. (%) | 0 | 0 | 0 |
| Kappa (—) | 9.1 | 6.7 | 8.4 |
| Delignification (%) | 67.0 | 75.7 | 69.6 |
| Brightness | 57.9 | 58.0 | 57.3 |

[1)] in form of hydrogen peroxide

[2)] in form of Caroat ® (Triplesalt of approx. 45% $KHSO_5$, 25% $KHSO_4$ and 30% $K_2SO_4$ - approx. formula is $2KHSO_5.KHSO_4.K_2SO_4$[4)]).

[3)] in form of "on-site generated" Caro's acid $H_2SO_5$. Caro's acid was manufactured by mixing slowly 96% sulfuric acid with 70% hydrogen peroxide drop by drop. Magnetic stirring assured intensive agitation while the flask was cooled in an ice bath so that the temperature of the reaction solution never exceeded 10° C. Total addition time, i.e. reaction time was 45 minutes. After this time, the reaction solution was quickly poured onto ice so that the resulting concentration of Caro's acid was below 200 g/l. Before applying the Caro's acid solution to the pulp, the peroxomonosulfate and the $H_2O_2$ concentration were determined by two titrations with potassium iodide and with permanganate.

The results show that Caroat was consumed to a higher degree than $H_2O_2$. As reaction conditions are the same, it confirms that the hydrogen peroxomonosulfate is the reactive molecule. Most likely $HSO_5^-$ attaches the benzenic ring of lignin principally in a manner as described below:

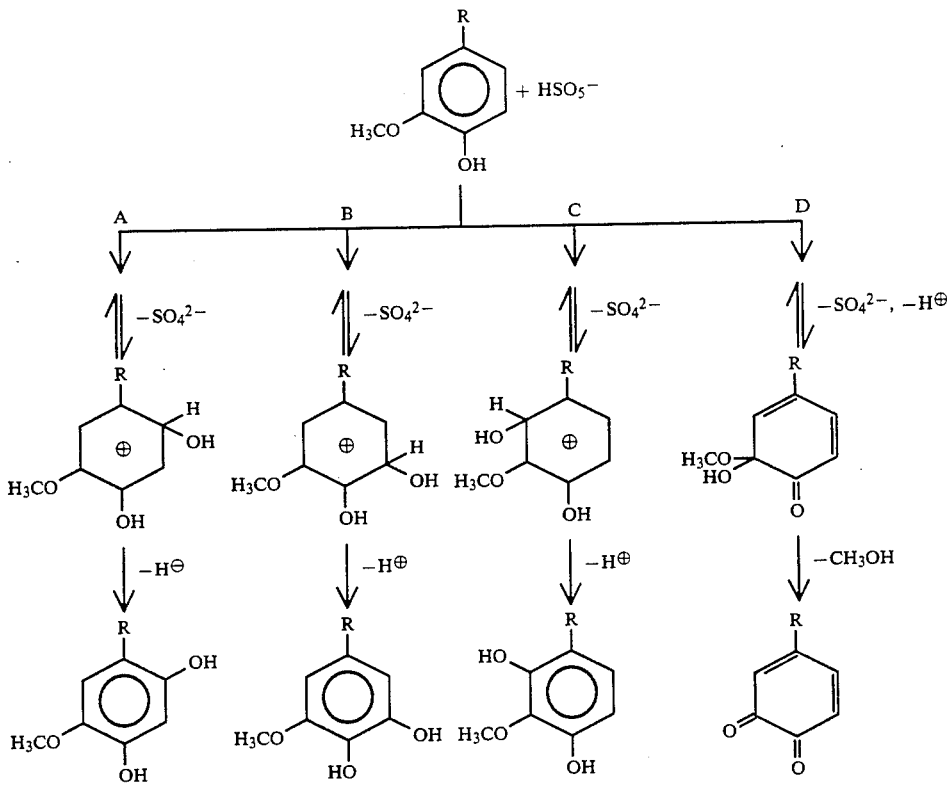

Although it is generally confirmed that the reaction is catalyzed by hydroxonium cations (low pH), the reaction should also be faster with higher concentrations of phenolate anions (higher pH). The results also show that oxygen and hydrogen peroxide delignify more efficiently in the subsequent Op stage after the pretreatment with Caroat and Caro's acid. The reason why Caroat worked even more efficiently than Caro's acid is simply due to the fact that Caro's acid is a mixture of $H_2O_2$, $H_2SO_5$ and $H_2SO_4$, i.e. not all AO applied is applied as $H_2SO_5$, the more reactive compound.

This example proves firstly, that peroxomonosulfuric acid reacts faster than hydrogen peroxide under comparable conditions; and, secondly, that the higher consumption of AO leads to higher delignification rates in a subsequent oxygen stage.

EXAMPLE 2

Unbleached southern hardwood kraft pulp was subjected to the same acid washing as described in Example 1. The pulp was then divided into 8 even samples of 50 g O.D. each. Reaction conditions and pulp properties are outlined in Table 2. Between the oxidative pretreatment and the oxygen stage thorough washing with deionized water was applied to the pulp in order to prevent interferences due to carry-over of different amounts of residual chemicals

TABLE 2

| Trial No. | 1 | 2 | 3 | 4 | 5 | 6 | 7 | 8 |
|---|---|---|---|---|---|---|---|---|
| Raw Material After Acid Wash | | | | | | | | |
| Kappa | 14.0 | 14.0 | 14.0 | 14.0 | 14.0 | 14.0 | 14.0 | 14.0 |
| Brightness, % | 27.1 | 27.1 | 27.1 | 27.1 | 27.1 | 27.1 | 27.1 | 27.1 |
| Viscosity, mPas | 18.3 | 18.3 | 18.3 | 18.3 | 18.3 | 18.3 | 18.3 | 18.3 |
| Oxidative Pretreatment | | | | | | | | |
| AO % | — | 0.50* | 0.50 | 0.50 | 0.50 | 0.50 | 0.50 | 1.00 |
| NaOH % | — | — | 1.40 | 1.40 | 1.40 | 1.80 | 2.00 | 3.40 |
| $MgSO_4$ % | — | 0.05 | 0.05 | 0.05 | 0.05 | 0.05 | 0.05 | 0.05 |
| Cons. % | — | 15 | 15 | 15 | 15 | 15 | 15 | 15 |
| Time, min | — | 60 | 15 | 60 | 120 | 60 | 60 | 120 |
| Temp. °C. | — | 60 | 25 | 25 | 25 | 40 | 60 | 60 |
| pH initial | — | 3.0 | 7.6 | 7.7 | 7.6 | 9.2 | 9.3 | 9.3 |
| pH final | — | 3.1 | 4.8 | 4.1 | 3.3 | 3.9 | 3.4 | 3.0 |
| Residual AO % | — | .44 | .33 | .31 | .23 | .10 | .02 | .12 |
| Oxygen Stage | | | | | | | | |
| $O_2$, MPa | 0.3 | 0.3 | 0.3 | 0.3 | 0.3 | 0.3 | 0.3 | 0.3 |
| NaOH % | 3.2 | 3.2 | 3.2 | 3.2 | 3.2 | 3.2 | 3.2 | 3.2 |
| $MgSO_4$ % | 0.05 | 0.05 | 0.05 | 0.05 | 0.05 | 0.05 | 0.05 | 0.05 |

TABLE 2-continued

| Trial No. | 1 | 2 | 3 | 4 | 5 | 6 | 7 | 8 |
|---|---|---|---|---|---|---|---|---|
| Cons. % | 20 | 20 | 20 | 20 | 20 | 20 | 20 | 20 |
| Time, min | 60 | 60 | 60 | 60 | 60 | 60 | 60 | 60 |
| Temp. °C. | 100 | 100 | 100 | 100 | 100 | 100 | 100 | 100 |
| pH initial | 12.8 | 12.8 | 12.7 | 12.8 | 12.6 | 12.8 | 12.8 | 12.5 |
| pH final | 11.9 | 12.2 | 12.2 | 12.0 | 12.1 | 12.1 | 12.0 | 12.1 |
| Brightness % | 49.8 | 51.2 | 54.6 | 53.4 | 54.4 | 56.4 | 56.3 | 60.4 |
| Kappa | 8.3 | 8.1 | 6.2 | 5.4 | 5.1 | 4.9 | 4.6 | 3.5 |
| Delignification % | 40.7 | 42.1 | 55.7 | 61.4 | 63.6 | 65.0 | 67.1 | 75.0 |
| Viscosity, mPas | 16.1 | 12.0 | 16.2 | 16.1 | 17.0 | 15.5 | 15.3 | 14.7 |
| Viscosity loss % | 12.0 | 34.4 | 11.5 | 12.0 | 7.1 | 15.3 | 16.4 | 19.7 |

*AO (Active oxygen was applied in form of hydrogen peroxide) in all other trials Caroat was used.

The results of these trials show that oxygen delignified by far more selectively after treatment with Caroat (peroxomonosulfate). The difference compared to acid hydrogen peroxide (pretreatment trial 21) is not only even higher delignification in the O stage it is the superior selectivity of oxygen in the O stage that is dramatically improved by the X pretreatment. Compared to the standard oxygen stage (trial #1) delignification could be improved in trial 8 by 84% rel. At the same time, viscosity dropped by only 9%.

Additional trials were performed identical to trial #4 except that the NaOH charge in the X stage was varied in order to see the effect of pH in the X stage on delignification efficiency of the following O stage.

TABLE 3

| Trial No. | 9 | 10 | 11 | 12 | 13 | 14 |
|---|---|---|---|---|---|---|
| NaOH charge | — | 0.10 | 0.80 | 2.00 | 2.80 | 3.60 |
| pH initial | 1.40 | 3.1 | 3.7 | 9.3 | 10.4 | 10.5 |
| pH final | 1.40 | 2.4 | 3.2 | 4.8 | 7.7 | 9.8 |
| brightness after $O_2$ | 50.9 | 50.6 | 51.0 | 53.4 | 57.0 | 57.9 |
| Kappa after $O_2$ | 6.9 | 6.9 | 5.9 | 5.4 | 5.9 | 6.1 |
| Viscosity after $O_2$ | 16.0 | 15.9 | 16.2 | 16.6 | 15.6 | 15.7 |

These trials showed the applicability of the X stage over a wide pH range. An optimum in efficiency could be found around a final pH of 3 to 5.

EXAMPLE 3

The same unbleached hardwood kraft pulp was acidic washed as described under Example 1. Afterwards, the pulp was bleached in a $X_1$—O—$X_2$—Eo—P to a final brightness of 76.5 and a final viscosity of 13.1. Bleaching the pulp in $X_1$—O—$X_2$—Eo—D, final brightness and viscosity was 85.3 and 12.8, respectively. Chemical charges and reaction conditions were (X=0.5% AO (Caroat); 1.8% NaOH; O=3.2% NaOH, 0.3 MPa $O_2$; $X_2$=0.25% AO (Caroat); Eo=1.6% NaOH, 0.3 MPa $O_2$ and P=0.47% $H_2O_2$ and 0.8% NaOH).

A final brightness of 86.3% ISO and final viscosity of 12.2 could be achieved bleaching the same raw material in a $X_1$—O—$X_2$—Eop—D sequence. All chemical charges were the same as in trial 1. 1.0% active chlorine as $ClO_2$ was applied in the final D stage and in Eop: 0.4% $H_2O_2$. This example demonstrated that repeated application of the "X—[OX]" -Process led to fully bleached pulp brightness levels.

EXAMPLE 4

Unbleached southern pine kraft pulp was treated according to Example 1. The reaction parameters are outlined in the table below. This example should compare the effects the X—[OX] process has on strength properties compared to a common oxygen delignification. The "X—[OX]" process (trial 2), compared to regular oxygen delignification (Trial 1), yielded a 53% higher delignification rate and a pulp with a brightness of 4.4 points higher, a tear index of 42% higher, the burst index was 3% higher and the Tensile index was 14% higher. Compared to all other known processes that enhance oxygen delignification, these results were surprising and unexpected.

TABLE 4

| Trial No. | 1 Reference | 2 |
|---|---|---|
| Raw material | | |
| Kappa | 23.7 | 23.7 |
| Acid wash | + | + |
| Pretreatment | | |
| AO (%) (Caroat ®) | — | 0.5 |
| NaOH (%) | — | 1.8 |
| Consistency (%) | — | 15 |
| Temperature (°C.) | — | 40 |
| Time (min.) | — | 60 |
| pH initial | — | 8.8 |
| pH final | — | 3.6 |
| Residual AO (%) | — | 0.03 |
| Oxygen stage | | |
| $MgSO_4$ (%) | 0.5 | 0.5 |
| $O_2$ (MPa) | 0.3 | 0.3 |
| NaOH (%) | 3.2 | 3.2 |
| Consistency (%) | 20 | 20 |
| Time (min.) | 60 | 60 |
| Temperature (°C.) | 100 | 100 |
| pH initial | 12.3 | 12.5 |
| pH final | 10.6 | 10.5 |
| Brightness (%) | 32.2 | 36.6 |
| Kappa | 15.1 | 10.5 |
| Delignification (%) | 36.3 | 55.7 |
| Tear index ($mNm^2/g$) | 7.10 | 10.09 |
| Tensile index (Nm/g) | 6.75 | 7.69 |
| Burst index ($kPam^2/g$) | 4.95 | 5.09 |
| Breaking length (km) | 11.2 | 12.0 |
| CSF (ml) | 500 | 500 |

In a relative recent paper ("Pretreatment of Kraft Pulp is the Key to Easy Final Bleaching", by Greta Fossum and Ann Marklund, TAPPI, Proc. 1988 International Pulp Bleaching Conference, pp. 253-261), a variety of pretreatments are compared.

EXAMPLE 5

In order to find out the contribution each chemical ($HSO_5^-$, $O_2$ and NaOH) has in the overall effect, another series of trials was conducted. Unbleached southern pine kraft pulp was treated according to Example 1 prior to performing various bleaching trials, as described in Table 5. In order to identify each chemical contribution to the overall effects of the "X—[OX]" treatment, the following procedure was chosen.

The prewashed raw material was split into two even parts of pulp. One part was subjected to the X treatment, the other part was subjected to the same treatment but no active oxygen was added. After completion of the first step, both pulp samples were diluted with deionized water to 2% consistency, dewatered on a Buchner funnel, thoroughly washed with even parts of water and thickened to 30% consistency.

Both samples were divided again into two even parts of pulp. All samples were subjected to oxygen delignification conditions (even in the same reactor), except that one of each pair of samples was charged with nitrogen instead of oxygen. By that, the effect of oxygen, together with caustic soda and the effect of caustic soda alone, could be investigated.

TABLE 5

| Trial | 1 | 2 | 3 | 4 |
|---|---|---|---|---|
| Raw Material | E | O | X-E | X-O |
| Kappa # | 27.8 | 27.8 | 27.8 | 27.8 |
| Viscosity [MPa.s] | 30.9 | 30.9 | 30.9 | 30.9 |
| Brightness [%] | 27.6 | 27.6 | 27.6 | 27.6 |
| 1st Stage | | | | |
| AO (Caroat) (%) | — | — | 0.25 | 0.25 |
| NaOH (%) | 0.25 | 0.25 | 0.80 | 0.80 |
| Consistency | 15 | 15 | 15 | 15 |
| Temperature (°C.) | 40 | 40 | 40 | 40 |
| Time (min) | 60 | 60 | 60 | 60 |
| pH Initial | 4.5 | 4.5 | 6.8 | 6.8 |
| pH Final | 4.5 | 4.5 | 3.3 | 3.3 |
| Residual AO (%) | — | — | 0.10 | 0.10 |
| Brightness (%) | 27.5 | 27.5 | 29.3 | 29.3 |
| 2nd Stage | | | | |
| $O_2$ (MPa) | — | 0.3 | — | 0.3 |
| $N_2$ (MPa) | 0.3 | — | 0.3 | — |
| Consistency (%) | 20 | 20 | 20 | 20 |
| Time (min) | 60 | 60 | 60 | 60 |
| Temperature (°C.) | 100 | 100 | 100 | 100 |
| NaOH % | 3.2 | 3.2 | 3.2 | 3.2 |
| pH Initial | 12.8 | 12.9 | 12.8 | 12.9 |
| pH Final | 12.5 | 12.5 | 12.5 | 12.2 |
| Brightness (%) | 31.7 | 37.2 | 33.5 | 40.6 |
| Kappa (%) | 24.7 | 22.0 | 17.2 | 13.0 |
| Viscosity (%) | 30.8 | 20.3 | 27.7 | 22.4 |

The results provide the synergistic effects of the combined (sequential) treatment of pulp with, first, peroxomonosulfuric acid and, second, an oxygen delignification stage.

| | | |
|---|---|---|
| Effect on Brightness Increase | | |
| NaOH | in E | +4.1 |
| NaOH + $O_2$ | in O | +9.6 |
| $O_2$ | (O minus E) | +5.5 |
| $HSO_5^-$ + NaOH | in [X-E] | +5.9 |
| $HSO_5^-$ | [X-E] minus E | +1.8 |
| Theoretical brightness increase is | | 11.4 |
| Effects of NaOH + $O_2$ + $HSO_5^-$ = Actual brightness increase in X-O was | | 13.0 |
| Effect on Kappa Number Reduction (Delignification) | | |
| NaOH | in E | 3.1 |
| NaOH + $O_2$ | in O | 5.8 |
| $O_2$ | (O minus E) | 2.7 |
| $HSO_5^-$ + NaOH | in [X-E] | 10.6 |
| $HSO_5^-$ | [X-E] minus E | 7.5 |
| Theoretical Kappa number reduction is | | 13.3 |
| Effects of NaOH + $O_2$ + $HSO_5^-$ = Actual Kappa number reduction in X-O was | | 14.8 |
| Effect on Viscosity Loss | | |
| NaOH | in E | 0.1 |
| NaOH + $O_2$ | in O | 10.6 |
| $O_2$ | (O minus E) | 10.5 |
| $HSO_5^-$ + NaOH | in [X-E] | 3.2 |
| $HSO_5^-$ | [X-E] minus E | 3.1 |
| Theoretical viscosity loss is | | 13.7 |
| Effects of NaOH + $O_2$ = $HSO_5^-$ = Actual viscosity loss in X-O was | | 8.5 |

The results demonstrate that although the delignification rate achieved with X—O was clearly higher than in O, the viscosity loss was much less than expected.

The "X—[OX]" process proved to have synergistic effects on brightness increase, delignification, viscosity preservation and strength characteristics.

Further variations and modifications of the foregoing will be apparent to those skilled in the art and are intended to be encompassed by the appended claims.

We claim:

1. A process for bleaching and delignification consisting essentially of reacting lignocellulosic pulp for a period of time up to 2 hours with a source of peroxomonosulfuric acid, at a starting pH between 7 and 11 the reaction continuing until a final pH of 3 to 5, subsequently subjecting said pulp to an oxygen or peroxide or oxygen and peroxide delignifying and bleaching stage to obtain the desired degree of delignification or brightness or delignification and brightness without significant cellulose degradation or increase in viscosity loss, while strength properties of the pulp are improved.

2. The process according to claim 1, wherein a peroxide stabilizer is added to the treatment with peroxomonosulfuric acid.

3. The process according to claim 2, wherein the stabilizer is DTPA, EDTA, DTPMPA, silicate or Mg salts.

4. The process according to claim 1, wherein the peroxomonosulfuric acid treatment is carried out a temperature of 5° C. to 100° C.

5. The process according to claim 4, wherein the peroxomonosulfuric acid treatment is carried out at a temperature of 15° C. to 70° C.

6. The process according to claim 1, wherein the solids content in the peroxomonosulfuric acid treatment is 0.1 to 60%.

7. The process according to claim 6, wherein the solids content in the peroxomonosulfuric acid treatment is 1 to 30%.

8. The process according to claim 1, wherein 0.01% active oxygen to 3% active oxygen is used in the peroxomonosulfuric acid treatment.

9. The process according to claim 8, wherein 0.05% active oxygen to 1.5% active oxygen is used in the peroxomonosulfuric acid treatment.

10. The process according to claim 1, wherein the pressure in the peroxomonosulfuric acid treatment is atmospheric to 0.5 MPa.

11. The process according to claim 1, wherein the subsequent stage contains only oxygen.

12. The process according to claim 1, wherein the subsequent stage contains only peroxide.

13. The process according to claim 11, wherein the temperature is between 20° and 140° C. in the subsequent stage.

14. The process according to claim 13, wherein the final pH is between 7 and 14 in the subsequent stage.

15. The process according to claim 13, wherein no cellulose protecting additives are used in the subsequent stage.

16. The process according to claim 13, wherein cellulose protecting additives are used in the subsequent stage.

17. The process according to claim 13, whereby no peroxide stabilizers are used in the subsequent stage.

18. The process according to claim 13, wherein peroxide stabilizers are used in the subsequent stage.

19. The process according to claim 11, wherein the retention time is 1 second to 24 hours in the subsequent stage.

20. The process according to claim 19, wherein the reaction time is between 5 and 120 minutes.

21. The process according to claim 11, wherein the consistency is between 5 and 30% in the subsequent stage.

22. The process according to claim 11, wherein the pressure is between 0.1 MPa and 2 MPa in the subsequent stage.

23. A process for bleaching and delignification consisting essentially of reacting lignocellulosic pulp for a period of time up to 2 hours with a source of peroxomonosulfuric acid, at a starting pH between 7 and 11 the reaction continuing until a final pH of 3 to 5, subsequently subjecting said pulp to an oxygen or peroxide or oxygen and peroxide delignifying and bleaching stage to obtain the desired degree of delignification or brightness or delignification and brightness without significant cellulose degradation or increase in viscosity loss, while strength properties of the pulp are improved, wherein the pulp is contacted with an agent to remove heavy metal contamination prior to treatment with peroxomonosulfuric acid.

24. A process for bleaching and delignification consisting essentially of reacting lignocellulosic pulp for a period of time up to 2 hours with a source of peroxomonosulfuric acid, at a starting pH between 7 and 11 the reaction continuing until a final pH of 3 to 5, subsequently subjecting said pulp to an oxygen or peroxide or oxygen and peroxide delignifying and bleaching stage to obtain the desired degree of delignification or brightness or delignification and brightness without significant cellulose degradation or increase in viscosity loss, while strength properties of the pulp are improved, wherein one or more intermediate washing steps are carried out between the peroxomonosulfuric acid treatment and the subsequent oxygen or peroxide or oxygen and peroxide treatment.

25. The process according to claim 24, wherein fresh water is used as dilution or wash water or dilution and wash water, in the one or more intermediate washing steps.

26. The process according to claim 24, wherein the filtrate of the subsequent oxygen or peroxide or oxygen and peroxide stage is used as dilution or wash water or dilution and wash water, in the one or more intermediate washing steps.

27. The process according to claim 24, wherein said one or more intermediate washing steps utilizes any water which does not negatively affect the process's efficiency, is used in the one or more intermediate washing steps.

* * * * *

UNITED STATES PATENT AND TRADEMARK OFFICE

CERTIFICATE OF CORRECTION

PATENT NO. : 5,091,054

DATED : February 25, 1992

INVENTOR(S) : Juergen Meier and Gerhard Arnold

It is certified that error appears in the above-identified patent and that said Letters Patent is hereby corrected as shown below:

On the title page, item [54] and in col. 1, lines 1 and 2, the discrepancy pertains to the title being incorrectly printed as "PROCESS FOR BLEACHING AND DELIGNIFICATION OF LIGNOCELLULOSIC"; the correct title is "PROCESS FOR BLEACHING AND DELIGNIFICATION OF LIGNOCELLULOSIC PULP WITH PEROXOMONOSULFURIC ACID FOLLOWED BY A PEROXIDE AND/OR OXYGEN STAGE".

Signed and Sealed this

Thirteenth Day of April, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 5,091,054

DATED : February 25, 1992

INVENTOR(S) : MEIER ET AL.

It is certified that error appears in the above-identified patent and that said Letters Patent is hereby corrected as shown below:

On title page, item [75], add the following Inventors; --Juergen Meier, Elmwood Park, N. J. Gerhard Arnold, Ringwood, New Jersey; and Oswald Helmling, Hasselroth Fed. Rep. Germany.

Signed and Sealed this

Fifth Day of October, 1993

Bruce Lehman

*Attest:*

BRUCE LEHMAN

*Attesting Officer*

*Commissioner of Patents and Trademarks*